US005685751A

United States Patent [19]

Feyas

[11] Patent Number: 5,685,751

[45] Date of Patent: Nov. 11, 1997

[54] QUICK RELEASE SURFBOARD LEASH

[76] Inventor: Larry Feyas, 957 Dans Pl., Lake Worth, Fla. 33463

[21] Appl. No.: 675,689

[22] Filed: Jul. 3, 1996

[51] Int. Cl.[6] ..... B63H 21/28

[52] U.S. Cl. ..... 441/75

[58] Field of Search ..... 441/75, 74, 79; 114/39.2, 230

[56] References Cited

U.S. PATENT DOCUMENTS

| | | | |
|---|---|---|---|
| 4,610,634 | 9/1986 | Kimura . | |
| 4,733,625 | 3/1988 | Allen | 114/230 |
| 4,938,725 | 7/1990 | Beck . | |
| 5,199,916 | 4/1993 | Prickett . | |
| 5,243,710 | 9/1993 | Craycroft . | |
| 5,324,220 | 6/1994 | Stewart | 441/75 |
| 5,531,622 | 7/1996 | Nealy | 441/75 |

*Primary Examiner*—Stephen Avila
*Attorney, Agent, or Firm*—Pennie & Edmonds, LLP

[57] ABSTRACT

A surfboard leash with a quick release mechanism for disconnecting the surfer with a surfboard is disclosed. The quick release mechanism is connected in line to the surfboard leash, with a first end of the surfboard leash attached to the surfboard and a second end of the surfboard leash attached to the ankle of the surfer. The quick release mechanism has a male portion and a female portion in releasably locking relationship. The male portion, when locked into place in the female portion, is spring loaded so that when a release ring is compressed, the male portion is pushed out of the female portion, which in turn disconnects the surfer from the surfboard.

10 Claims, 5 Drawing Sheets

QUICK RELEASE SURFBOARD LEASH

TECHNICAL FIELD OF THE INVENTION

The present invention relates to surfboard leashes, and more particularly, to a quick release surfboard leash.

BACKGROUND OF THE INVENTION

Surfboards commonly have a leash that attaches to the surfer's leg by the ankle to the surfboard, so that in the event of a fall of the surfboard, the surfboard and the surfer will not become separated.

A surfboard leash is described in U.S. Pat. No. 4,610,634 issued to Kimura, which discloses a surfboard leash with a first fastener at a first end attaching to the surfboard, and a second fastener at a second end attaching to the ankle of the surfer. Swivels in the leash help to prevent the leash from becoming entangled.

U.S. Pat. No. 4,938,725 issued to Bech discloses a retractable surfboard leash. The leash attaches to the ankle of the surfer at a first end and is attached to a spring activated spool at a second end. The spring activated spool is connected to the surfboard.

U.S. Pat. No. 5,199,916 issued to Prickett discloses a releasable anchor plug for a surfboard. The anchor plug attaches to a surfboard leash and is designed to provide quick release of the leash from the surfboard.

Further, a need has been recognized to provide a leash that provides a quick release of the leash from the surfer's leg, such as in the case when the surfer, the surfboard, or the surfboard leash become entangled with a rock, coral reef, buoy, submerged debris, or any other object that may become entangled with the surfer and his equipment. A number of surfers are injured every year because their surfboard leashes become entangled with submerged articles.

U.S. Pat. No. 5,243,710 issued to Craycroft discloses a releasable locking device for a surfboard. The device has a pin that locks with a tongue, the pin is fastened to the ankle strap with hook and loop fasteners. In the event of an emergency, the surfer has to locate the pin and pull the pin directly up to disengage the tongue.

What is needed is a surfboard leash with a quick release mechanism that allows the surfer to activate the mechanism with one relatively simple motion.

DISCLOSURE OF THE INVENTION

It is, therefore, an object of the present invention to provide a surfboard leash with a quick release mechanism to disconnect the surfer from the surfboard.

It is also an object of the present invention to provide a surfboard leash with a quick release mechanism, wherein the quack release mechanism is relatively easy for the surfer to locate in the event of an emergency.

It is also an object of the present invention to provide a surfboard leash with a quick release mechanism, wherein relatively few movements by the surfer are required to activate the quick release mechanism.

According to the present invention, a surfboard leash with a quick release mechanism for disconnecting the surfer with a surfboard is disclosed. The quick release mechanism is connected in line with the surfboard leash, with a first end of the surfboard leash attached to the surfboard and a second end of the surfboard leash attached to the ankle of the surfer. The quick release mechanism is connected to the surfboard leash with a swivel at each end to prevent the leash from becoming tangled. The quick release mechanism has a male portion and a female portion. The female portion has a pair of levers that are spring loaded to lock the male portion to the female portion. A release ring encompasses the pair of levers, so that when the release ring is compressed, the levers release the locking relationship between the male portion and the female portion. The male portion, when locked into place with the female portion, is spring loaded so that when the release ring is compressed, the male portion is pushed out of the female portion, which in turn disconnects the surfer from the surfboard. The quick release mechanism is housed in a spherical resilient shell so that the surfer may activate the quick release mechanism by squeezing the shell, which in turn compresses the release ring.

The foregoing and other advantages of the present invention will become more apparent from the following description and accompanying drawings.

BEST MODE FOR CARRYING OUT THE INVENTION

Figure 1:
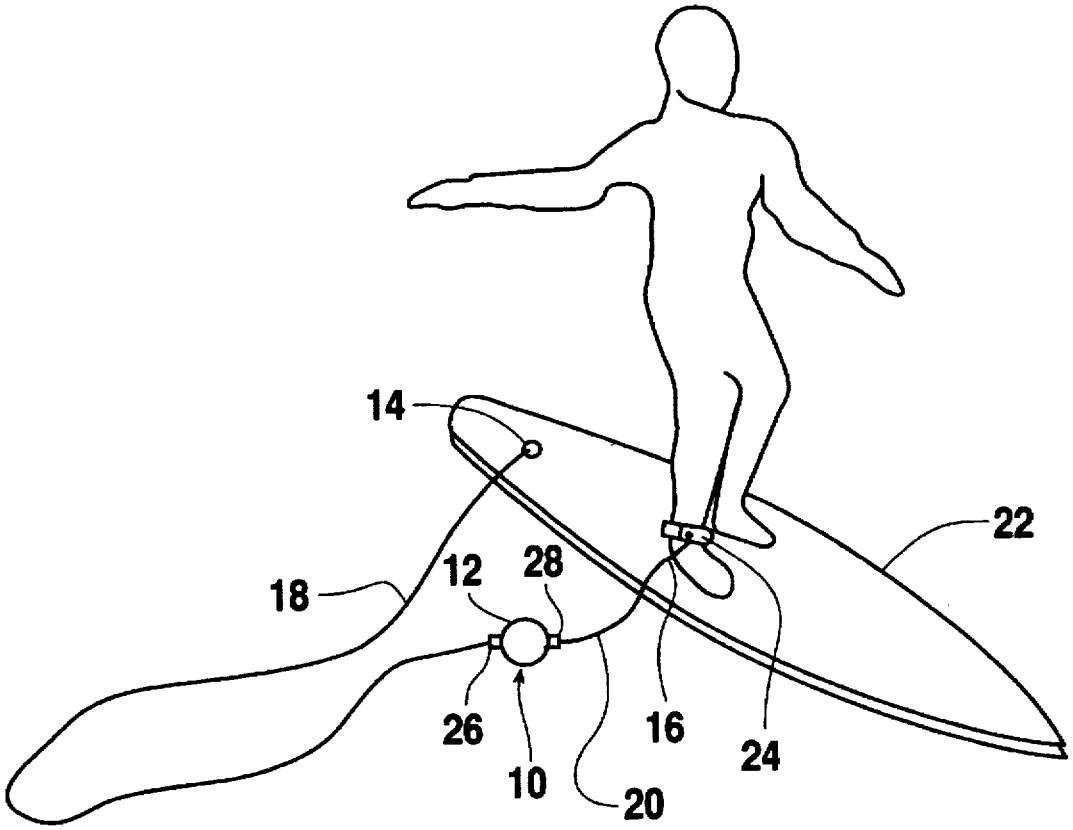
FIG. 1 is a front perspective view of surfer on a surfboard with a quick release surfboard leash of the present invention connecting the surfer to the surfboard.

According to the present invention, and as shown in FIG. 1, a quick release surfboard leash 10 is disclosed, wherein the surfboard leash 10 has a quick release mechanism 12, a leash first end 14 connecting to a surfboard 22, and a leash second end 16 connecting to an ankle fastener 24. The ankle fastener 24 connects the surfer to the surfboard 22, so in the event of a fall, the surfer is not separated from the surfboard 22. However, in the event that the surfboard leash 10 becomes entangled with an object in the water, such as a coral reef or a buoy, the quick release mechanism 12 of the present invention allows the surfer to easily and quickly separate from the surfboard 22.

The surfboard leash 10 has a first leash portion 18 and a second leash portion 20. The first leash portion 18 is connected to the surfboard 14 and the second leash portion 20 is connected to the ankle fastener 24. The quick release mechanism 12 of the present invention separates the first leash portion 18 from the second leash portion 20 at the quick release mechanism 12.

Figure 2:
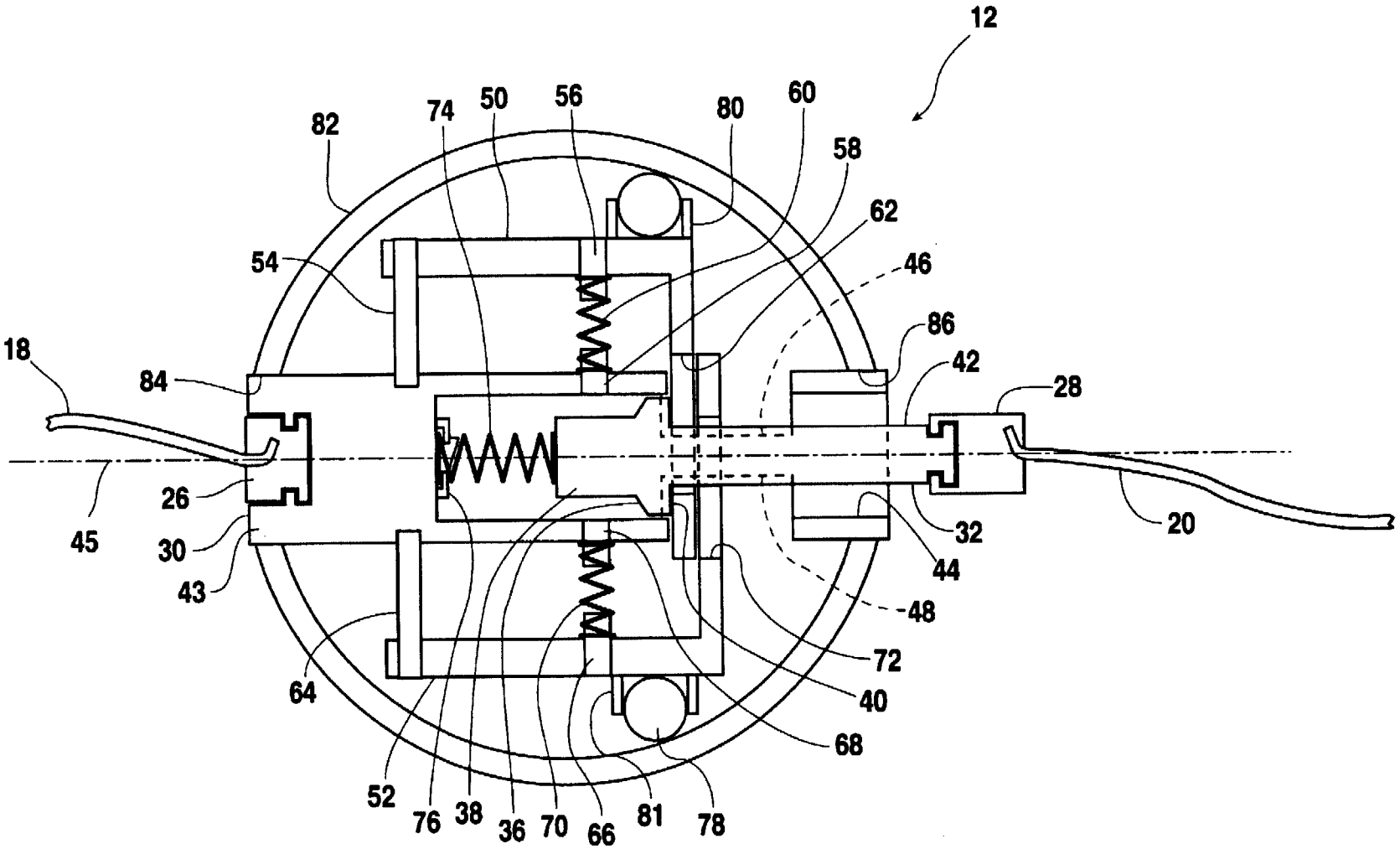
FIG. 2 is a cross sectional view of the quick release surfboard leash of the present invention, showing a male portion in a locking relationship with a female portion.

As shown in FIG. 2, the quick release mechanism 12 has a first swivel 26 and a second swivel 28 to prevent the leash portions 18 and 20 from becoming entangled between the surfer and the surfboard 22. The quick release mechanism 12 has a female portion 30 and a male portion 32. The male portion 32 has an interfitting and releasably locking relationship with the female portion 30.

The male portion 32 has a linear and cylindrical configuration and has a first end 38 and an opposite second end 42.

Adjacent to the first end 38 is a raised shoulder 34 with a chamfer 36 on the forward side of the raised shoulder 34. The raised shoulder 34 has an aft shoulder surface 40 opposite of the chamfer 36. The second swivel 28 is rotatably attached to the male portion second end 42.

The female portion 30 comprises a coupling 43 with a major axis 45 and a bore 44. The coupling 43 and bore 44 are concentric with each other and aligned with the major axis 45. The coupling 43 and the bore 44 have a linear and cylindrical configuration complementary to the male portion 32. The male portion shoulder 34 interfits with the female bore 44. The coupling 43 has a first slot 46 and an opposite second slot 48. The slots 46 and 48 traverse the major axis 45 and extend into the bore 44.

Figure 3:
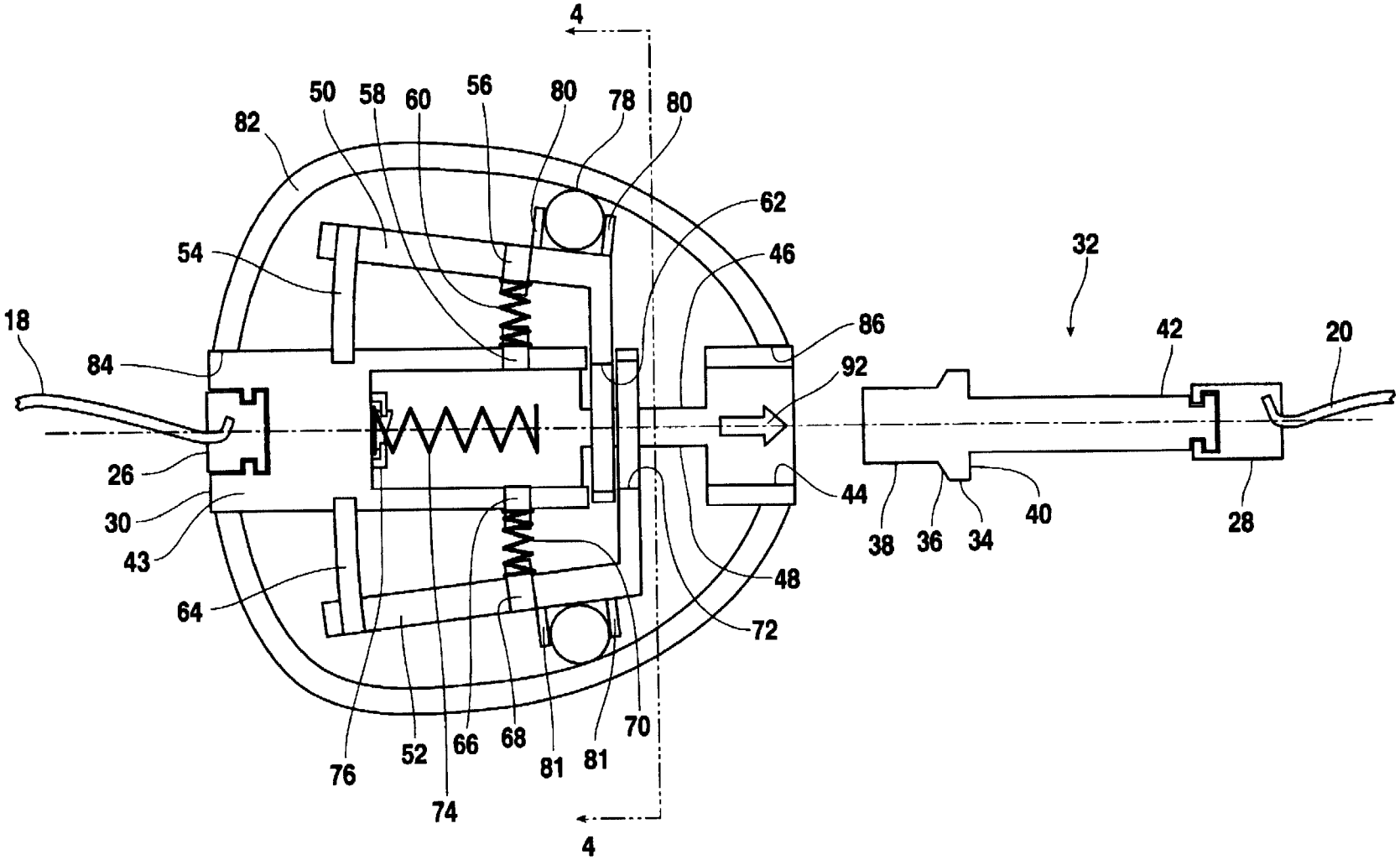
FIG. 3 is a cross sectional view of the quick release surfboard leash of the present invention, showing the male portion free from the female portion.

The female portion 30 also has a first "L" shaped lever 50 and a second "L" shaped lever 52. The levers 50 and 52 are made of a resilient plastic material that allows slight deformation of the levers under force and that allows the levers 50 and 52 to spring back to their original "L" shape when not under a load. Therefore, both levers 50 and 52 are pivotly connected to the female portion 30. The first lever 50 is pivotly connected to the coupling 43 by a first post 54 and the second lever 52 is pivotly connected to the coupling 43 by a second post 64. The posts 54 and 64 are press fit into the coupling 43 and the respective levers. The first lever 50 has a first lever passageway 62 and likewise, the second lever 52 has a second lever passageway 72. As shown in FIG. 3 and in FIG. 4, the levers 50 and 52 are connected to the coupling 43 so that the levers interfit with and are internal of the first slot 46 and the second slot 48, and so that when the levers are activated, as explained below, the lever passageways 62 and 72 are aligned and concentric with each other and with the coupling bore 44. A first lever pin 56 is connected to the first lever 50. Opposite of the first lever pin 56 is a first coupling pin 58 connected to the coupling 43. A first lever coiled spring 60 is positioned between the first lever pin 56 and the first coupling pin 58. The first lever spring 60 pushes the first lever 50 outward and away from the coupling 43 so that the first lever passageway 62 is not concentric with the coupling bore 44 or the second lever passageway 72 when the first lever is at rest.

Likewise, a second lever pin 66 is connected to the second lever 52. Opposite of the second lever pin 66 is a second coupling pin 68 connected to the coupling 43. A second lever coiled spring 70 is positioned between the second lever pin 66 and the second coupling pin 68. The second lever spring 70 pushes the second lever 60 outward and away from the coupling 43 so that the second lever passageway 72 is not concentric with the coupling bore 44 or the first lever passageway 62 when the second lever is at rest.

Located at the termination point of the bore 44 is a quick release coiled spring 74. The quick release spring 74 is attached to the coupling 43 by a spring anchor 76. The quick release spring 74 is smaller in diameter than the male portion first end 38.

Figure 5:
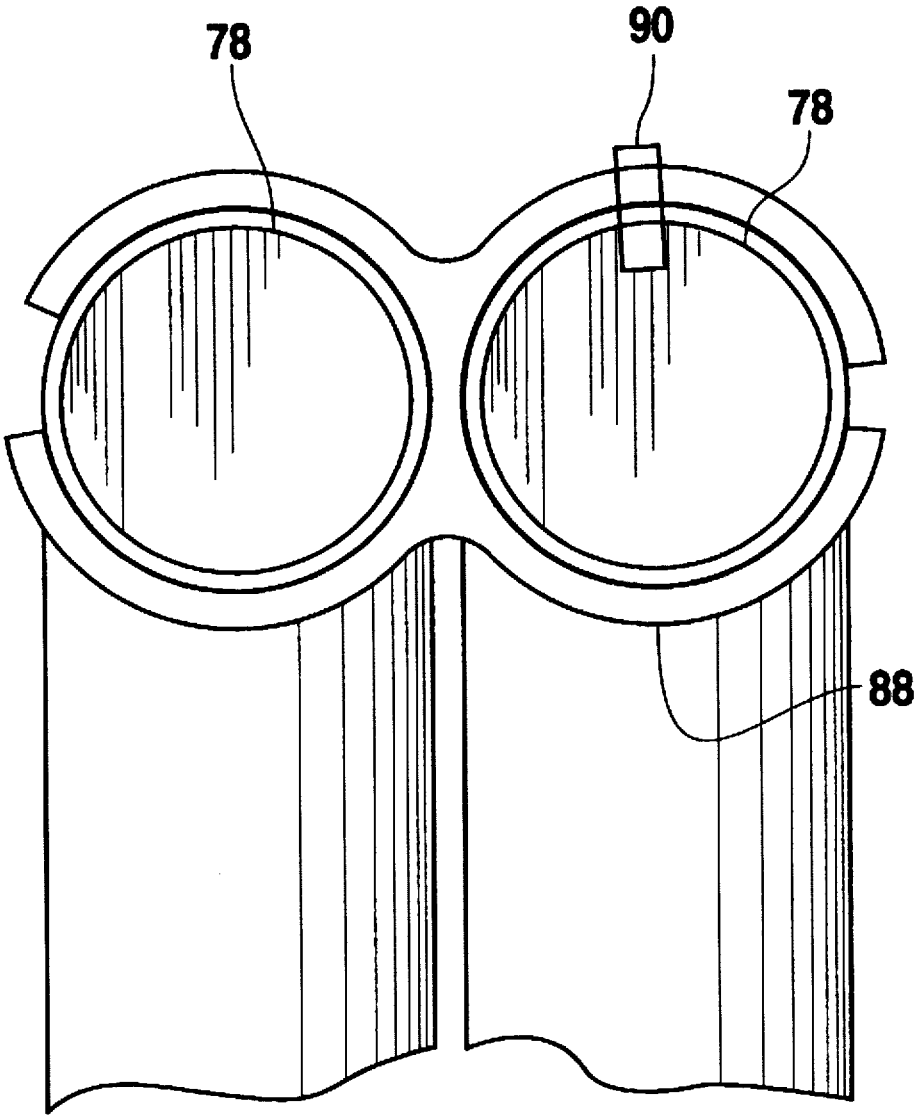
FIG. 5 is a partial cross sectional view of a release ring of the present invention, wherein a ring connecter is shown connecting the release ring.

A release ring 78 encircles the female portion 30 and the levers 50 and 52. The first lever 50 has a first lever ring guide 80, comprising a ridge slightly larger in width than the diameter of the release ring 78. The second lever 52 has a second lever ring guide 81 that is complementary to the first lever ring guide 80 and also comprises a ridge slightly larger in width than the diameter of the release ring 78. The internal diameter of the release ring 78 is slightly larger than the external dimensions of the first and second levers, excluding the ring guides 80 and 81. The release ring 78 is made of a metallic spring material, so that when the release ring 78 is activated or compressed, the release ring 78 springs back to the larger at-rest position. As shown in FIG. 5, the release ring is one coiled piece of spring material that is joined by a ring connecter 88. The ring connector 88 is a figure "8" piece that snaps onto the release ring outer diameter where the ring 78 overlaps. A ring pin 90 stakes the ring connector 88 to the release ring 78. The ring connector 88 has an internal diameter on each side so the release ring 78 has sufficient clearance to pass through the ring connector 88 when the quick release mechanism 12 is being activated.

The female portion 30 is housed in a resilient rubber shell or cover 82. The cover 82 has a first opening 84 for the coupling 43 and the first swivel 26. The cover 82 has an opposite second opening 86 for the coupling 43 and the male portion 32. The resilient cover 82 is sufficiently rigid to maintain a spherical shape, and sufficiently resilient to return to the spherical shape after being squeezed or activated by the surfer. The cover 82 is dyed with a very bright neon color so that the quick release mechanism 12 is highly visible to the surfer at all times, even when the quick release mechanism 12 is submerged in water.

As shown in FIG. 2, the quick release mechanism 12 is shown at rest. The male portion 32 is in a releasably locking relationship with the female portion 30. The male portion 32, when locked into the female portion 30, depresses the quick release spring 74. The first lever 50 and the second lever 52 are shown at rest, with the first lever 50 shown locking against the male portion shoulder 34 at the aft shoulder surface 40. As shown in FIG. 2, the first leash portion 18 and the second leash portion 20 are connected by the quick release mechanism 12.

Figure 4:
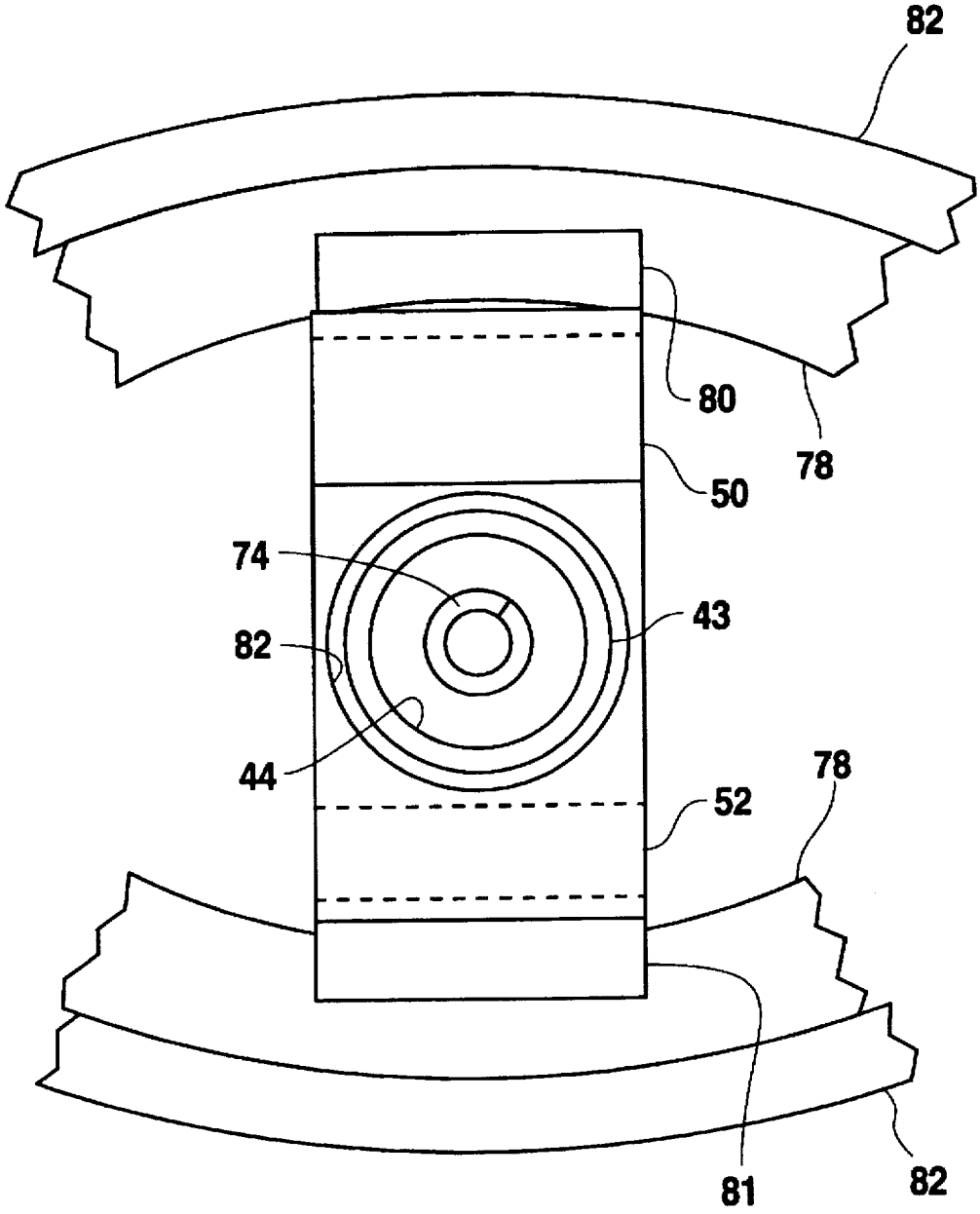
FIG. 4 is a partial cross sectional view taken from line 4—4 of FIG. 3, showing the quick release surfboard leash of the present invention in quick release mode.

As shown in FIG. 3 and in FIG. 4, the quick release mechanism 12 is shown activated, wherein the surfer has squeezed the cover 82, depressed the release ring 78, which in turn has compressed the levers 50 and 52. The levers 50 and 52 compress the first and second lever springs 60 and 70. When the levers 50 and 52 are compressed, the lever passageways 62 and 72 are aligned concentrically with the coupling bore 44, freeing the male portion shoulder 32 from the levers 50 and 52. The quick release spring 74 then uses its stored kinetic energy to force the male portion 32 out of the female portion in the direction of arrow 92. Upon the separation of the male portion 32 and the female portion 30, the first leash portion 18 and the second leash portion 32 are separated, and the surfer is disconnected from the surfboard 22.

Therefore, when the surfer has encountered a situation that requires the surfer to become disconnected to the surfboard 22, the surfer merely applies pressure to the outside of the quick release mechanism 12 via the cover 82, and the leash 10 will become separated into two portions, with the first portion 18 being connected to the surfboard 22 and the second portion 20 being connected to the surfer.

Although this invention has been shown and described with respect to a detailed embodiment, those skilled in the art will understand that various changes in form and detail may be made without departing from the spirit and scope of the claimed invention.

I claim:

1. A surfboard leash release mechanism, comprising:

a leash having a first leash portion at one end adapted to be connected to a surfboard and a second leash portion adapted to be connected to the ankle of a surfer, the two leash portions being connected by said release mechanism;

a female portion and a male portion, said portions being in a releasably locking relationship with each other;

said female portion having means to unlock from said male portion, said unlock means comprising a first lever and a second lever, said levers each having a lever passageway adapted to interfit and lock said male portion to said female portion, said female portion also having a quick release spring means; and a release ring located external of said levers so that when said release ring is compressed, said levers compress and said lever passageways align and unlock said male portion and said quick release spring means separates said male portion from said female portion.

2. A surfboard leash release mechanism of claim 1, further comprising:

said female portion having a major axis with a coupling and a bore, said bore said coupling and said axis being concentric with each other; said female portion further having a first "L" shaped lever, an opposite second "L" shaped lever, a first slot and a second slot, said slots being traverse with said axis, said levers being pivotly connected to said coupling with each lever having a lever passageway, said passageways being larger in diameter than said bore, said lever passageways being located internally of said slots;

said lever passageways being not aligned with said bore while at rest;

a first lever spring being located between said first lever and said coupling;

a second lever spring being located between said second lever and said coupling;

said quick release spring means comprising a coiled spring housed internally of said coupling at said bore;

said male portion having a raised shoulder, said shoulder being smaller in diameter than said lever passageways and said bore, said levers releasably locking against said raised shoulders locking said male portion internal of said coupling;

a release ring located external of said levers, so that when said release ring is compressed, said levers compress and said lever passageways align with said bore and said male portion is forced out of said female portion by said quick release spring.

3. A surfboard leash release mechanism of claim 2, further comprising:

a first lever ring guide located external of the first lever;

a second lever ring guide located external of the second lever, said release ring being located internal of said ring guides.

4. A surfboard leash release mechanism of claim 2, further comprising:

a ring connector for connecting said release ring together, said release ring having a first end and a second end, said ring being in a coiled configuration with said ends being overlapped, said ring connector being fixedly attached to the release ring at said first end and slidably attached to the release ring at said second end.

5. A surfboard leash release mechanism of claim 2, wherein said release ring is made of a resilient spring material.

6. A surfboard leash release mechanism of claim 2, wherein said female portion further comprises a first swivel connecting to said first leash portion; said male portion further comprises a second swivel connecting to said second leash portion.

7. A surfboard leash release mechanism of claim 2, wherein said female portion is enclosed in a resilient cover, said resilient cover has a first opening for said first leash portion and a second opening for said second leash portion.

8. A surfboard leash release mechanism of claim 1, further comprising:

said female portion having a major axis with a coupling and a bore; said bore, said coupling and said axis being concentric with each other; said female portion further having a first "L" shaped lever, an opposite second "L" shaped lever, a first slot and a second slot, said slots being traverse with said axis, said levers being pivotly connected to said coupling with each lever having a lever passageway, said passageways being larger in diameter than said bore, said lever passageways being located internally of said slots.

9. A surfboard leash release mechanisms of claim 8, wherein the lever passageways are not aligned with said bore while at rest.

10. A surfboard leash release mechanism of claim 8, further comprising:

a first lever spring being located between said first lever and said coupling; and a second lever spring being located between said second lever and said coupling.

* * * * *